US012392531B2

(12) United States Patent
Hafner et al.

(10) Patent No.: US 12,392,531 B2
(45) Date of Patent: Aug. 19, 2025

(54) METHOD OF OPERATING A REFRIGERATION CYCLE APPARATUS

(71) Applicant: VIESSMANN CLIMATE SOLUTIONS SE, Allendorf (DE)

(72) Inventors: Ulrich Hafner, Burgwald (DE); Christopher Wrede, Medebach (DE)

(73) Assignee: VIESSMANN CLIMATE SOLUTIONS SE, Allendorf (DE)

( * ) Notice: Subject to any disclaimer, the term of this patent is extended or adjusted under 35 U.S.C. 154(b) by 262 days.

(21) Appl. No.: 18/029,219

(22) PCT Filed: Oct. 6, 2021

(86) PCT No.: PCT/DE2021/100800

§ 371 (c)(1),
(2) Date: Mar. 30, 2023

(87) PCT Pub. No.: WO2022/073556

PCT Pub. Date: Apr. 14, 2022

(65) Prior Publication Data

US 2023/0358450 A1 Nov. 9, 2023

(30) Foreign Application Priority Data

Oct. 9, 2020 (DE) ..... 10 2020 126 579.4

(51) Int. Cl.
*F25B 41/31* (2021.01)
*F25B 13/00* (2006.01)
(Continued)

(52) U.S. Cl.
CPC ..... *F25B 41/385* (2021.01); *F25B 13/00* (2013.01); *F25B 41/31* (2021.01); *F25B 49/02* (2013.01);
(Continued)

(58) Field of Classification Search
CPC ..... F25B 41/385; F25B 41/31; F25B 13/00; F25B 49/02; F25B 2600/2513; F25B 2700/171
See application file for complete search history.

(56) References Cited

U.S. PATENT DOCUMENTS 5,052,472 A * 10/1991 Takahashi ..... F25B 49/025 257/E23.098
2006/0080989 A1 4/2006 Aoki et al.
(Continued)

FOREIGN PATENT DOCUMENTS

DE 102 39 877 A1 3/2004
DE 10 2013 113 221 A1 6/2015
(Continued)

OTHER PUBLICATIONS

International Search Report in PCT/DE2021/100798, mailed Jan. 21, 2022.
(Continued)

*Primary Examiner* — Nael N Babaa
(74) *Attorney, Agent, or Firm* — Collard & Roe, P.C.

(57) ABSTRACT

A method of operating a refrigeration cycle apparatus uses a compressor to compress a coolant. The compressed coolant is fed to a condenser for release of heat, the condensed coolant is later fed to a primary side of an internal heat exchanger for release of heat, and the cooled coolant is guided through an expansion device. The coolant expanded in the expansion device is fed to an evaporator for absorption of heat, the evaporated coolant is later fed to a secondary side of the internal heat exchanger for absorption of heat, and the heated coolant is fed to the compressor. For suction gas temperature control, an amount of heat transferred from the primary side to the secondary side of the internal heat exchanger is controlled with the aid of an additional expan-
(Continued)

sion device arranged parallel to the heat exchanger and between the condenser and the evaporator.

10 Claims, 2 Drawing Sheets

(51) Int. Cl.
*F25B 41/385* (2021.01)
*F25B 49/02* (2006.01)

(52) U.S. Cl.
CPC . *F25B 2600/2513* (2013.01); *F25B 2700/171* (2013.01)

(56) References Cited

U.S. PATENT DOCUMENTS

| | | | | |
|---|---|---|---|---|
| 2017/0151856 | A1 | 6/2017 | Kuwahara | |
| 2018/0192544 | A1* | 7/2018 | Reynov | H05K 7/20318 |
| 2018/0328598 | A1* | 11/2018 | Callemo | F25B 30/02 |
| 2019/0135075 | A1* | 5/2019 | Hwang | B60H 1/00278 |
| 2019/0257532 | A1 | 8/2019 | Sakabe et al. | |
| 2019/0257562 | A1 | 8/2019 | Walter | |

FOREIGN PATENT DOCUMENTS

| | | | |
|---|---|---|---|
| DE | 10 2014 102 005 | A1 | 6/2015 |
| DE | 11 2015 003 005 | T5 | 3/2017 |
| DE | 10 2017 107 051 | A1 | 10/2018 |
| EP | 1 519 127 | A1 | 3/2005 |
| EP | 1 647 783 | A2 | 4/2006 |
| EP | 2 083 229 | B1 | 7/2009 |
| EP | 2 489 774 | B1 | 6/2015 |
| JP | H02-73562 | U | 6/1990 |
| WO | 2017/212058 | A1 | 12/2017 |

OTHER PUBLICATIONS

International Search Report in PCT/DE2021/100800, mailed Jan. 21, 2022.

Wikipedia document, "Expansion Valve" (see also https://de.wikipedia.org/w/index.php?title=Expansionsventil&oldid=179418293) Last edited Jul. 24, 2018; Retrieved on Mar. 29, 2023.

Wikipedia document, "Plate Heat Exchanger" (see also https://de.wikipedia.org/w/index.php?title=Plattenw%C3%A4rme%C3%BCbertrager&oldid=199812395), Last edited May 10, 2020; Retrieved on Mar. 29, 2023.

English translation of the International Preliminary Report on Patentability and Written Opinion of the International Searching Authority in PCT/DE2021/100800, dated Mar. 28, 2023.

* cited by examiner

METHOD OF OPERATING A REFRIGERATION CYCLE APPARATUS

CROSS REFERENCE TO RELATED APPLICATIONS

This application is the National Stage of PCT/DE2021/100800 filed on Oct. 6, 2021, which claims priority under 35 U.S.C. § 119 of German Application No. 10 2020 126 579.4 filed on Oct. 9, 2020, the disclosure of which is incorporated by reference. The international application under PCT article 21(2) was not published in English.

The invention relates to a method of operating a refrigeration cycle apparatus according to the preamble of claim 1.

A method of the type mentioned in the introduction is disclosed in the patent document US 2006/0080989.

A method of the type mentioned in the introduction is also disclosed in the patent document DE 11 2015 003 005 T5. In this method (see in particular claim 1 of this document, and namely the variant described as the first coolant circuit, and FIG. 1) a coolant is compressed by a compressor, wherein the compressed coolant is fed to a condenser for release of heat, wherein coolant condensed in the condenser is later fed to a primary side of an internal heat exchanger for release of heat, wherein the coolant cooled down on the primary side of the internal heat exchanger is guided through an expansion valve, wherein the coolant expanded in the expansion valve is fed to an evaporator for absorption of heat, wherein the coolant evaporated in the evaporator is later fed to a secondary side of the internal heat exchanger for absorption of heat, wherein the coolant heated on the secondary side of the internal heat exchanger (which is why this heat exchanger is also called the suction gas heat exchanger) is fed to the compressor. The above stipulation "later" is understood to mean in this case and also hereinafter that the evaporator is configured to be selectively connected directly to the secondary side of the internal heat exchanger or by the interposition of further refrigeration circuit components, such as for example a liquid separator.

The object of the invention is to improve a method of the type mentioned in the introduction. In particular, a method is intended to be provided by which the supply of vaporous coolant to the compressor can be particularly easily controlled.

This object is achieved by a method of the type mentioned in the introduction by the features explained in the characterizing part of claim 1.

According to the invention, therefore, it is provided that, for suction gas temperature control, an amount of heat transferred from the primary side to the secondary side of the internal heat exchanger is controlled with the aid of an additional expansion device, preferably an additional expansion valve (see also https://de.wikipedia.org/w/index.php?title=Expansionsventil &oldid=179418293) arranged parallel to the internal heat exchanger and between the condenser and the evaporator.

In other words, the method according to the invention is thus characterized in that an additional expansion device is used to control the suction gas temperature, wherein this additional expansion device is arranged parallel to the internal heat exchanger and between the condenser and the evaporator. The stipulation "parallel" which is used here is understood to mean in the sense of the term "parallel circuit" known from electrical engineering (thus in particular not geometrically), i.e. according to the invention the additional expansion device is arranged in a bypass around the internal heat exchanger and the expansion device, wherein additionally the expansion device is preferably also used to control the suction gas temperature. Expressed in more specific terms, it is thus provided that a connector of the additional expansion device is configured to be connected directly to a connector of the evaporator (in particular via a line and without the interposition of further heat pump components). Moreover, it is also preferably provided that a connector of the evaporator is configured to be connected via a fork-shaped line both directly to a connector of the expansion device (as already explained) and directly to a connector of the additional expansion device.

In the claimed solution, the additional expansion device, as explained, is arranged parallel to the internal heat exchanger and between the condenser and the evaporator. Moreover, a further solution is also preferably provided, however, in which two additional expansion devices are provided, which will be discussed in more detail below.

Preferably, it is also provided that all of the aforementioned expansion devices are configured to be adjustable or controllable. In one option, however, and which will also be explained in more detail below, one of the three expansion devices could be configured to be uncontrollable or fixed.

From the prior art mentioned in the introduction—purely considered in terms of the subject matter—an apparatus is disclosed in which, on the one hand, an expansion device is connected downstream of the internal heat exchanger and, on the other hand, an additional expansion device is connected upstream of the internal heat exchanger. In this solution, however, the additional expansion device (here 17*a*) claimed in the characterizing part of claim 1 is only used to the extent that coolant flows therethrough. The additional expansion device has an expanding or decompressing action only after switching to the second coolant circuit, which is ultimately configured as a double circuit, and in which the primary side of the internal heat exchanger (here 18*a*) is connected upstream of the additional expansion device (here—as already explained—17*a*).

The aforementioned variant in which the transferred quantity of heat is controlled with the aid of an additional expansion device arranged parallel to the internal heat exchanger and between the condenser and the evaporator, in terms of the subject matter is not known from the prior art mentioned in the introduction. In this regard, reference is also made to the subject claim 7 for carrying out the method according to the invention.

Further advantageous developments of the method according to the invention are found in the dependent claims.

For the sake of completeness, reference is also made to the following documents:

A refrigeration cycle apparatus is disclosed in the document EP 1 519 127 A1 which also has an additional expansion device but this additional expansion device is arranged between the evaporator and the compressor as a bypass to the internal heat exchanger.

A refrigeration cycle apparatus is also disclosed in the document EP 2 489 774 B1 in which according to the German translation so-called control devices are provided (here reference signs 30, 32, 34, 36, 46, 48 and 50); but reading the original English version shows that these control devices are "on-off valves" or "three-way valves", i.e. in particular not throttle means (see also reference sign 18 "throttle means") or additional expansion devices as are provided according to the invention for controlling a pressure drop which is relevant to the suction gas temperature.

A refrigeration cycle apparatus is also disclosed in the document DE 10 2013 113 221 A1, in which a controllable shut-off apparatus is connected upstream of the internal heat exchanger. In this case, however, it is not an additional expansion device in the sense of the solution according to the invention but quite specifically a 3-way valve (here reference sign 17A) by which the mass flow of the coolant is intended to be controlled (and thus in particular not the pressure drop thereof).

A refrigeration cycle apparatus is disclosed in the document WO 2017/212058 A1 in which the coolant can be guided past the internal heat exchanger (or in any case a part thereof) with the aid of a bypass line, wherein so-called controllable valves (here reference signs 14 and 22) are provided for fixing the diverted mass flow. These controllable valves, however, are never arranged parallel to the expansion device (here reference sign 4).

Reference is also made in this case to the further documents DE 10 2014 102 005 A1 and DE 10 2017 107 051 A1. However, these documents, in particular, have no internal heat exchanger in the sense of claim 1.

Finally, reference is also made to the documents DE 102 39 877 A1, JP H02 73 562 U and US 2019/0257532 A1.

The method according to the invention, including the advantageous developments thereof according to the dependent claims, is explained in more detail hereinafter with reference to the graphic representation of various exemplary embodiments.

Schematically:

Figure 3:
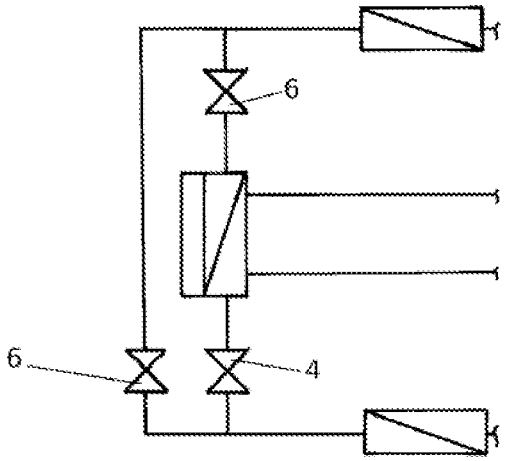
Figure 4:
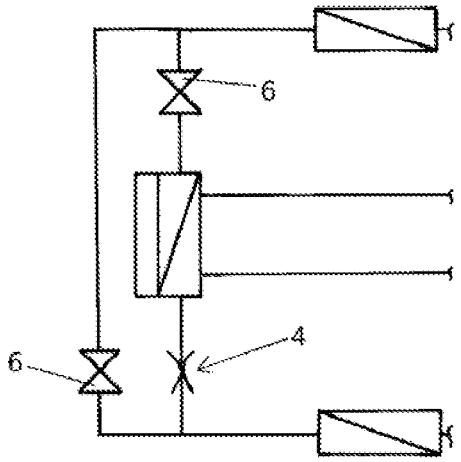

FIG. 3 shows a second embodiment of the refrigeration cycle apparatus according to the invention comprising an additional expansion device connected downstream of the condenser and upstream of the internal heat exchanger and arranged parallel to the heat exchanger and between the condenser and the evaporator; and FIG. 4 shows a third embodiment of the refrigeration cycle apparatus according to the invention in which, as in the second embodiment, two additional expansion devices are provided and in which the expansion device is configured as a fixed throttle.

The four refrigeration cycle apparatuses shown in the figures (apart from FIG. 1) are all suitable for implementing the method according to the invention for operating a refrigeration cycle apparatus. In this method, a coolant is initially compressed in the known manner by a compressor 1, wherein the compressed coolant is fed to a condenser 2 for release of heat, wherein coolant condensed in the condenser 2 is later fed to a primary side 3.1 of an internal heat exchanger 3 for release of heat, wherein the coolant cooled down on the primary side 3.1 of the internal heat exchanger 3 is guided through an expansion device 4, wherein the coolant expanded in the expansion device 4 is fed to an evaporator 5 for absorption of heat, wherein the coolant evaporated in the evaporator 5 is later fed to a secondary side 3.2 of the internal heat exchanger 3 for absorption of heat, wherein the coolant heated on the secondary side 3.2 of the internal heat exchanger 3 is fed to the compressor 1.

Figure 1:
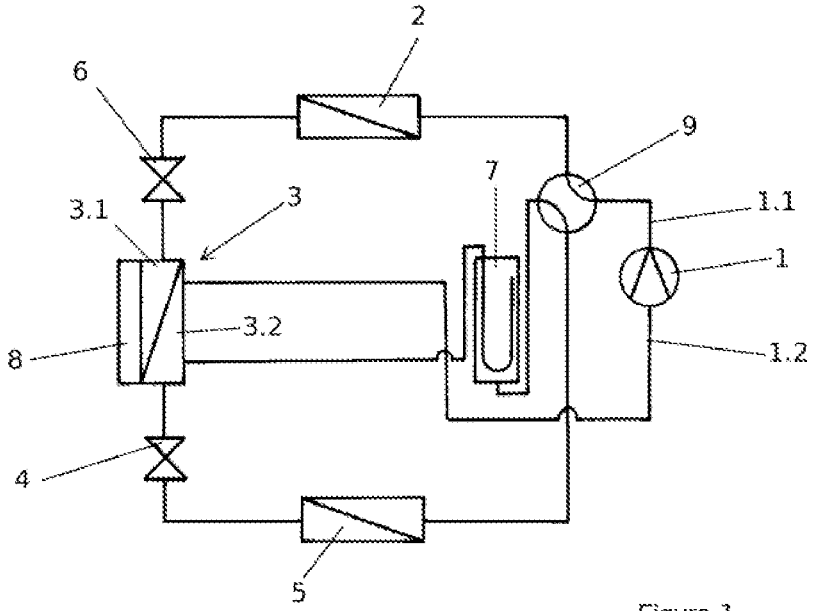
FIG. 1 shows an embodiment of a refrigeration cycle apparatus (not according to the invention) comprising an additional expansion device connected downstream of the condenser and upstream of the internal heat exchanger.

As can be seen from FIG. 1, it is particularly preferably provided that a changeover valve 9, preferably a 4-2 way valve, which is connected both to a pressure side 1.1 and to a suction side 1.2 of the compressor 1, is provided for switching between a heating mode and a cooling mode (i.e. two operating modes in which the refrigeration cycle apparatus can be operated). In the switching position of the changeover valve 9 shown in FIG. 1, which is called operating mode I hereinafter, as specified above, in this case the reference sign 2 is assigned to the condenser and the reference sign 5 is assigned to the evaporator. After the changeover valve 9 is switched (which is called operating mode II hereinafter) the heat exchanger with the reference sign 5 then becomes the condenser and correspondingly the heat exchanger with the reference sign 2 becomes the evaporator.

Whether the operating mode I is denoted as the heating mode or the cooling mode ultimately depends simply on the direction in which the heat transport takes place or is intended to take place. Hereinafter for the sake of simplicity—and which is also possible due to the (substantially) symmetrical construction of the refrigeration cycle apparatus according to the invention—the operating mode I is equivalent to the heating mode and the operating mode II is equivalent to the cooling mode.

Figure 2:
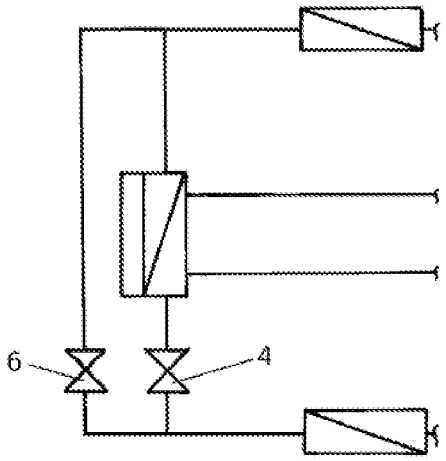
FIG. 2 shows a first embodiment of the refrigeration cycle apparatus according to the invention comprising an additional expansion device arranged parallel to the heat exchanger and between the condenser and the evaporator.

It is thus essential for the method according to the invention that, for suction gas temperature control, an amount of heat transferred from the primary side 3.1 to the secondary side 3.2 of the internal heat exchanger 3 is controlled with the aid of an additional expansion device 6 arranged parallel to the heat exchanger 3 and between the condenser 2 and the evaporator 5. This solution is shown in FIG. 2. It is also particularly preferably provided that, for suction gas temperature control, an amount of heat transferred from the primary side 3.1 to the secondary side 3.2 of the internal heat exchanger 3 is also controlled with the aid of a further additional expansion device 6 connected downstream of the condenser 2 and connected upstream of the internal heat exchanger 3. This variant is shown in FIGS. 3 and 4.

This has the result, therefore, that in the solution according to the invention at least two expansion devices always have to be configured to be controllable. In the solutions according to FIGS. 2 and 3 in each case these two expansion devices are the expansion device 4 and the additional expansion device 6. In the solution according to FIG. 4, however, the expansion device 4 is configured to be uncontrollable or fixed (i.e. as a simple throttle) while the control takes place via the two additional expansion devices 6 arranged parallel to one another, wherein the fixed expansion device 4 can then be arranged downstream of the internal heat exchanger 3.

It is further preferably provided that the coolant evaporated in the evaporator 5 is initially fed to a liquid separator 7 and then to the secondary side 3.2 of the internal heat exchanger 3. Alternatively, expressed in terms of the subject matter: viewed in the direction of flow of the coolant, a liquid separator 7 is arranged between the evaporator 5 and the secondary side 3.2 of the internal heat exchanger 3. As can also be seen in FIG. 1, such a liquid separator consists of a container which is configured to be connected at its lower end to the evaporator 5 (or in operating mode II correspondingly to the condenser). Moreover, a pipe which is bent in a U-shaped manner is provided, said pipe having an opening at its one free end and at its lowest point. The pipe is connected with its other free end to the secondary side 3.2 of the internal heat exchanger 3. Coolant vapor is suctioned via the opening at the free end. The opening at the lowest point serves to suction a mixture of coolant and oil deposited in the container and to feed it to the compressor for lubrication.

In other words, with reference to FIG. 1, wherein this can also apply to the embodiments according to FIGS. 2 to 4, it is preferably provided that, in the selected switching position (operating mode I) of the changeover valve 9 and when viewed in the direction of flow of the coolant, the liquid separator 7 is arranged between the evaporator 5 and the secondary side 3.2 of the internal heat exchanger 3. Based on the other operating mode, i.e. operating mode II, the liquid separator 7 is arranged between the heat exchanger 2 operating as an evaporator and the secondary side 3.2 of the internal heat exchanger 3.

It is further preferably provided that, in particular in heating mode, at least one additional expansion device 6 is controlled for a suction gas superheat of 5 to 15 K. In the embodiment according to FIG. 2 exactly one additional expansion device 6 is provided; as can be seen in the embodiments according to FIGS. 3 and 4, in each case two additional expansion devices 6 are provided, i.e. here in each case both additional expansion devices 6 are controlled such that said suction gas superheat is present or is produced.

Conversely, in the embodiment according to FIG. 3 for the other operating mode (i.e. the cooling mode), it is preferably provided that the expansion device 4 is fully opened for maximum suction gas superheat. The embodiment according to FIG. 2 is unsuitable for the cooling mode; in the embodiment according to FIG. 4 the expansion device 6, which is arranged between the heat exchanger 3 and the heat exchanger operating as an evaporator, is almost completely closed.

It is further preferably provided that, in particular in heating mode, for suction gas temperature control, at least one additional expansion device 6 is controlled as a function of a rotational speed of the compressor 1. Relative to this rotational speed dependency, it is particularly preferably provided in this case that with a low rotational speed of the compressor 1 in heating mode, the additional expansion device 6 is controlled for a suction gas superheat of 10 to 15 K. At a higher rotational speed of the compressor 1 in heating mode, alternatively it is preferably provided that the additional expansion device 6 is controlled for a suction gas superheat of 5 to 10 k.

For the above-described method in which the transferred quantity of heat is controlled with the aid of an additional expansion device 6 arranged parallel to the internal heat exchanger 3 and between the condenser 2 and the evaporator 5, a refrigeration cycle apparatus (see in particular FIG. 2)—formulated in terms of the subject matter—which consists of a compressor 1 for compressing a coolant is also provided, wherein—viewed in each case in the direction of flow of the coolant—a condenser 2 is connected downstream of the compressor 1, a primary side 3.1 of an internal heat exchanger 3 is connected downstream of the condenser 2, an expansion device 4 is connected downstream of the primary side 3.1, an evaporator 5 is connected downstream of the expansion device 4, a secondary side 3.2 of the internal heat exchanger 3 is later connected downstream of the evaporator 5 and the compressor 1 is connected downstream of the secondary side 3.2.

It is thus essential for this apparatus (see once again FIGS. 2 to 4) that, for suction gas temperature control, an additional expansion device 6 is arranged parallel both to the internal heat exchanger 3 and to the expansion device 4 and between the condenser 2 and the evaporator 5.

It is also particularly preferably provided that an electronic device 8 to be cooled, preferably a frequency converter, is arranged on the internal heat exchanger 3, preferably on the primary side 3.1 thereof.

It is more particularly preferably provided in this case that the heat exchanger 3 is configured as a plate heat exchanger (see also https://de.wikipedia.org/w/index.php?title=Plattenw%C3% A4rm e%C3%BCbertrager&oldid=199812395), wherein to avoid a formation of condensed water the (relatively warm) primary side 3.1 of the heat exchanger 3 is formed from external channels of the plate heat exchanger; and the secondary side 3.2 is thus arranged internally.

Finally, it is also preferably provided that a temperature at which heat is transferred from the electronic device 8 to be cooled to the internal heat exchanger 3, preferably to the primary side 3.1 thereof, is controlled by at least one additional expansion device 6.

For the sake of completeness, finally the mode of operation of the refrigeration cycle apparatus, shown in FIG. 1, is explained in both operating modes (apart from a different arrangement or number of additional expansion devices 6, this correspondingly also applies to the embodiments according to the invention according to FIGS. 2 to 4): As already explained, FIG. 1 shows the operating mode I in which the heat exchanger provided with the reference sign 2 is operated as a condenser. In this operating mode, the coolant is initially compressed by the compressor 1 and conveyed to a first flow path of the changeover valve 9 and then to the condenser 2. Once it has arrived there, the coolant then condenses and releases heat. Then the coolant passes to the additional expansion device 6 in order to be throttled there to a lower pressure. At the heat exchanger 3, on the one hand, heat is then transferred from the electronic device 8 to the coolant coming from the additional expansion device 6, flowing through the primary side 3.1 of the heat exchanger 3. On the other hand, at the same time heat is transferred from the primary side 3.1 of the heat exchanger 3 to the secondary side 3.2 thereof, more details thereof being provided below. Downstream of the primary side 3.1 the coolant then passes into the expansion device 4 where it is throttled again to an even lower pressure. Then the coolant passes to the evaporator 5 where it is supplied with heat so that in any case it is partially evaporated. Downstream of the evaporator 5 the coolant then passes to the second flow path of the changeover valve 9 and from there to the liquid separator 7, already described above in more detail. The substantially vaporous coolant passes therefrom to the secondary side 3.2 of the heat exchanger 3, as already mentioned above, for absorption of heat from the primary side 3.1 of the heat exchanger 3 which then, depending on the position of the expansion valves 4, 6, leads to an advantageous suction gas superheat of the coolant subsequently flowing to the compressor 1.

If the changeover valve 9 is now switched to the other operating mode (here the cooling mode), the coolant correspondingly no longer flows downstream of the compressor 1 at the changeover valve 9 to the heat exchanger (previously the condenser) 2 but directly to the heat exchanger 5 which now operates as a condenser, wherein coolant correspondingly flows through the expansion device 4, the primary side 3.1 of the heat exchanger 3, the additional expansion device 6 and the heat exchanger with the reference sign 2, which then operates as an evaporator, and then correspondingly in the reverse direction until the coolant then in turn passes to the changeover valve 9 and is also conducted therefrom back to the liquid separator 7, in order to pass back to the compressor 1 after passing the secondary side 3.2 of the heat exchanger 3.

REFERENCE LIST

1 Compressor
1.1 Pressure side
1.2 Suction side
2 Condenser
3 Internal heat exchanger
3.1 Primary side
3.2 Secondary side
4 Expansion device
5 Evaporator
6 Additional expansion device
7 Liquid separator
8 Electronic device
9 Changeover valve

The invention claimed is:

1. A method of operating a refrigeration cycle apparatus, wherein a coolant is compressed by a compressor (1), wherein the compressed coolant is fed to a condenser (2) for release of heat, wherein coolant condensed in the condenser (2) is later fed to a primary side (3.1) of an internal heat exchanger (3) for release of heat, wherein the coolant cooled down on the primary side (3.1) of the internal heat exchanger (3) is guided through a first expansion valve (4), wherein the coolant expanded in the first expansion valve (4) is fed to an evaporator (5) for absorption of heat, wherein the coolant evaporated in the evaporator (5) is later fed to a secondary side (3.2) of the internal heat exchanger (3) for absorption of heat, wherein the coolant heated on the secondary side (3.2) of the internal heat exchanger (3) is fed to the compressor (1), wherein, for suction gas temperature control, an amount of heat transferred from the primary side (3.1) to the secondary side (3.2) of the internal heat exchanger (3) is controlled with the aid of a second expansion valve (6) arranged parallel to the internal heat exchanger (3) in a bypass around the internal heat exchanger (3) and the first expansion valve (4) and between the condenser (2) and the evaporator (5).

2. The method according to claim 1, wherein, for suction gas temperature control, an amount of heat transferred from the primary side (3.1) to the secondary side (3.2) of the internal heat exchanger (3) is also controlled with the aid of a third expansion valve (6) connected downstream of the condenser (2) and connected upstream of the internal heat exchanger (3).

3. The method according to claim 1, wherein at least the second expansion valve (6) is controlled for a suction gas superheat of 5 to 15 K.

4. The method according to claim 3, wherein, for suction gas temperature control, at least the second expansion valve (6) is controlled as a function of a rotational speed of the compressor (1).

5. The method according to claim 1, wherein the coolant evaporated in the evaporator (5) is initially fed to a liquid separator (7) and then to the secondary side (3.2) of the internal heat exchanger (3).

6. The method according to claim 1, wherein a temperature at which heat is transferred from an electronic device (8) to be cooled to the internal heat exchanger (3) is controlled by at least the second expansion valve (6).

7. A device for carrying out the method according to claim 1, comprising a compressor (1) for compressing a coolant, wherein—viewed in each case in the direction of flow of the coolant—a condenser (2) is connected downstream of the compressor (1), a primary side (3.1) of an internal heat exchanger (3) is connected downstream of the condenser (2), a first expansion valve (4) is connected downstream of the primary side (3.1), an evaporator (5) is connected downstream of the first expansion valve (4), a secondary side (3.2) of the internal heat exchanger (3) is later connected downstream of the evaporator (5) and the compressor (1) is connected downstream of the secondary side (3.2), wherein, for suction gas temperature control, a second expansion valve (6) is arranged parallel to the internal heat exchanger (3) in a bypass around the internal heat exchanger (3) and the first expansion valve (4) and between the condenser (2) and the evaporator (5).

8. The device according to claim 7, wherein an electronic device (8) to be cooled is arranged on the internal heat exchanger (3).

9. The device according to claim 7, wherein, when viewed in the direction of flow of the coolant, a liquid separator (7) is arranged between the evaporator (5) and the secondary side (3.2) of the internal heat exchanger (3).

10. The device according to claim 7, wherein a changeover valve (9) connected both to a pressure side (1.1) and to a suction side (1.2) of the compressor (1) is provided for switching between a heating mode and a cooling mode.

* * * * *